US005133507A

United States Patent [19]

Sepling et al.

[11] Patent Number: 5,133,507

[45] Date of Patent: Jul. 28, 1992

[54] PROCEDURE AND APPARATUS FOR THE SORTING OF WOOD CHIPS

[75] Inventors: Matti Sepling, Rajamaki; Jorma Vuojolainen, Hollola; Matti Kahilahti, Lahti, all of Finland

[73] Assignee: Kone Oy, Helsinki, Finland

[21] Appl. No.: 707,185

[22] Filed: May 28, 1991

Related U.S. Application Data

[63] Continuation of Ser. No. 365,386, Jun. 13, 1989, abandoned.

[30] Foreign Application Priority Data

Jun. 20, 1988 [FI] Finland ..... 882928

[51] Int. Cl.[5] ..... B02C 19/12

[52] U.S. Cl. ..... 241/78; 209/44.1; 209/234; 209/935; 241/80; 241/81; 241/28

[58] Field of Search ..... 209/234, 235, 44.1, 209/672, 935, 420; 241/24, 80, 97, 29, 152 A, 75, 152 R, 76, 77, 81, 78, 28, 81

[56] References Cited

U.S. PATENT DOCUMENTS 3,069,101 12/1962 Wexell ..... 241/28 X 4,376,042 3/1983 Brown ..... 209/234 X

FOREIGN PATENT DOCUMENTS 8400874 10/1985 Netherlands ..... 241/28

OTHER PUBLICATIONS

Screening of Pulpwood Chips for Quality and Profit, Paper Trade Journal, Apr. 30, 1979.

*Primary Examiner*—Mark Rosenbaum

*Assistant Examiner*—Willmon Fridie, Jr.

*Attorney, Agent, or Firm*—Sughrue, Mion, Zinn, Macpeak and Seas

[57] ABSTRACT

A two-stage procedure is disclosed for sorting wood chips. The chips are directed to a gyratory screen in the first stage and to a disc screen in the second stage. The chip flow is divided in the first stage into four fractions of which the first fraction contains mainly oversized chips and is directed to a pin chipper, from which it emerges as suitable-sized chips and is directed back to the gyratory screen of the first stage. The second fraction contains acceptable sized chips and most of the overthick chips and is directed to the second or thickness screening stage. The third fraction consists mainly of acceptable chips and is directed to a pulping process, while the fourth fraction consists mainly of fine particles and is directed to a burning station. In the second or thickness screening stage the chip flow is divided into two fractions of which the rougher fraction comprises overthick chips and is directed via a rock and metal separating device into a slicing machine and then back to the first stage gyratory screen, while the finer fraction comprises acceptable chips and is passed directly to the pulping process.

9 Claims, 2 Drawing Sheets

PROCEDURE AND APPARATUS FOR THE SORTING OF WOOD CHIPS

This is a Continuation of application Ser. No. 07/365,386, filed Jun. 13, 1989 now abandoned.

FIELD OF THE INVENTION

The present invention relates to a two-stage procedure for sorting wood chips, in which the chips are directed to a gyratory screen in the first stage and to a disc screen in the second stage.

SUMMARY OF THE PRIOR ART

Previously known chip sorting methods generally consist of a single screening stage, using either a gyratory screen or a disc screen. For these methods to provide a sufficient yield, even overthick chips have to be admitted into the pulping process because they cannot be separated from the balance of the chip flow at a reasonable cost. Since the rate of absorption of the pulping chemicals depends on the thickness of the chips, pulp containing overthick chips has to be cooked for a longer time than pulp containing only chips of acceptable thickness. This involves the risk of overcooking of the smaller-sized acceptable chips and the small amount of fine particles contained among them, resulting in a weakening of the fibres in the pulp and consequently a deterioration of its quality. On the other hand, if the pulping process is so adjusted that the acceptable chip material is appropriately cooked, then the cooking time is insufficient for the oversized chips present, so that these will have to be removed from the pulp and recirculated into the pulping process. This arrangement again has the drawback that it requires complicated and expensive additional equipment for conveying the chips and for control and adjustment of the process.

Examples of the state of the art are found in U.S. Pat. No. 4,376,042 (Brown) and the references mentioned therein. This U.S. Pat. uses a gyratory screen to divide the chips into three fractions according to chip size. The first fraction contains chips of a size suitable for pulping. The second fraction contains oversized, overthick and acceptable-sized chips. The third fraction contains undersized particles and is directed to a burning station. The second fraction is passed further to a second screening stage, where it is sorted by means of a disc screen which produces a fourth fraction consisting of acceptable chips and a fifth fraction consisting of overthick chips. This fifth fraction of overthick chips is directed to a slicing machine, from which it emerges as acceptable-sized chips. The prior U.S. Pat. also proposes an arrangement whereby the fraction delivered from the slicing machine is redirected to the gyratory screen of the first stage and thus back into the sorting process. Chips of acceptable size are gathered together and directed to the pulping process.

A disadvantage of the process proposed by the above U.S. Pat. is the fact that the oversized fraction is allowed to pass through almost the entire process, which means that the disc screen used for thickness screening and the slicing machine of necessity receive an excessive amount of chips. This reduces the screening capacity and, moreover, the narrow input passage of the slicing machine may often be blocked by the oversized chips supplied, in which case the whole process is halted. In such a system, the disc screen has to be relatively large because of the large amount of chips supplied to it. Another drawback with the process proposed by this U.S. Pat. resides in the conveyor arrangement used for conveying the chips to the disc screen for thickness screening. The chips are accumulated on the conveyor and have to be spread out again with a separate screw spreader before input to the disc screen. All these facts add to the complexity of the apparatus, making it more expensive and more vulnerable. A further disadvantage is the fact that no provision is made for flexible temporary operation of the apparatus in case of malfunction or servicing of individual components, but instead the entire apparatus must be halted when a malfunction occurs, e.g. in the slicing machine or the disc screen. The slicing machine is a very demanding piece of equipment, requiring frequent servicing, e.g. because of a change of cutters. If the whole apparatus must be halted because of such operations, this reduces the overall capacity of the screening plant.

BRIEF SUMMARY OF THE INVENTION

An object of the present invention is to provide a chip sorting procedure which is free from the drawbacks mentioned and provides an optimum sorting capacity.

Accordingly, one aspect of the invention provides a two-stage process for sorting wood chips in which the chips are directed to a gyratory screen in a first stage and to a disc screen in a second stage, which process comprises dividing a flow of chips in the first stage into a first fraction containing mainly oversized chips which is directed to size reduction equipment and then recycled back to the gyratory screen of the first stage, a second fraction which comprises acceptable chips and most of the overthick chips and is directed to a thickness screening stage, a third fraction which consists mainly of acceptable chips and is directed to a pulping process, and a fourth fraction which comprises mainly fine particles and is directed to a burning station, and dividing the chip flow from said second fraction in the second or thickness screening stage into two fractions of which the rougher fraction comprises overthick chips which are directed to size reduction equipment and then recycled back to the first stage gyratory screen, while the finer fraction consists of acceptable chips.

Another aspect of the invention provides an apparatus for carrying out the process, which comprises a chip feeder, a gyratory screen disposed immediately after the feeder, means for separately conveying different-sized chip fractions obtained from the gyratory screen, a thickness screen, and conveying means for conveying acceptable chips either directly into a pulping process or into storage to await pulping, said gyratory screen comprising three screen decks, of a topmost deck separates out oversized chips, and a pin chipper is provided after said gyratory screen, the oversized chips obtained from said topmost deck of said gyratory screen being directed to said pin chipper for size reduction, and first pneumatic conveying means for conveying the chips from the pin chipper back to the infeed end of the gyratory screen.

The process of the invention provides the advantage that the chip flow is divided in the first stage into four separate streams, which can be further processed independently of each other. A further advantage is the fact that the chips admitted into the pulping process are of a highly uniform size, allowing for a more accurate control of the pulping process than in the case of chips sorted by current methods. The improved accuracy in the control of the pulping process enables economies to be achieved in the use of chemicals and leads to an increased fibre yield, thus heightening the overall capacity of the digester.

DESCRIPTION OF THE PREFERRED EMBODIMENTS

In a preferred embodiment of the invention, when necessary, the second fraction is also accepted and temporarily allowed to enter the pulping process directly together with the third fraction by removing the thickness screen from the path of the chip flow of the second fraction. The advantage of this arrangement is flexibility of the sorting process. Separating the oversized and overthick fractions from each other at the gyratory screening stage makes it possible to temporarily remove the disc screen used for thickness screening from the path of the chip flow consisting of the overthick fraction. This may become necessary, e.g. when the slicing machine is inoperative because of servicing and the sorting process should not be interrupted. When the overthick chips are admitted into the digester along with the acceptable fraction, this involves some deterioration in the pulping process, but in view of the overall effect this is still the best solution. If oversized chips were admitted into the digester along with the overthick chips, as would be the case in the procedure proposed by the above-mentioned U.S. Pat. were their disc screening step to be omitted, the screen could not in fact be removed, because the admission of oversized chips would cause excessive deterioration of the pulping process.

As mentioned above, the invention also relates to an apparatus for implementing the process, which apparatus comprises a chip feeder, a gyratory screen placed immediately after the feeder, equipment for conveying the different-sized chip fractions obtained from the gyratory screen, a thickness screen, a device for separating rocks and metals from the chips, a slicing machine and a conveying means for conveying the acceptable chips either directly into the pulping process or into storage to await pulping. The apparatus of the invention is characterized in that the gyratory screen consists of three screen decks, of which the topmost deck separates the oversized chips, and in that a pin chipper is provided after the gyratory screen to receive and split the oversized chips proceeding from the topmost deck of the gyratory screen, and in that the apparatus is provided with a conveying means to recycle the chips from the pin chipper back to the infeed end of the gyratory screen.

In a preferred embodiment of the apparatus, the disc screen used for thickness screening is located below the output end of the gyratory screen, so that the chip flow of the second fraction, consisting of acceptable and mainly overthick chips, falls from the gyratory screen directly onto the disc screen, and the disc screen is so mounted that it can be moved into and out of the path of the chip flow of the second fraction.

In another preferred embodiment of the apparatus, the disc screen is supported by wheels rotatably mounted on its lower part and running along a pair of essentially horizontal rails provided below the screen. In order to enable the screen to be moved, the screen is provided with power means capable of pushing and pulling the screen, e.g. a hydraulic cylinder, one end of which is attached to the disc screen and the other end to a fixed part of the apparatus.

In a third preferred embodiment of the apparatus of the invention, a rock and metal separating means is provided after the disc screen, and has a separating action based on the use of suction air. This separating means draws the overthick chips screened out by the disc screen and freed of rocks, metal and other heavy objects into a slicing machine, which is located above the infeed end of the gyratory screen.

The advantages of the apparatus of the invention are evident from those discussed above with respect to the process of the invention. The use of suction air to separate the chips from rocks and metal objects provides the advantage that even non-magnetic substances are removed from the chip flow and that the same device can be used to recycle the chips back to the infeed end of the gyratory screen.

BRIEF DESCRIPTION OF THE DRAWINGS

Further objects, features and advantages of the invention will become apparent to those skilled in the art from the following description thereof when taken in conjunction with the accompanying drawings, in which.

Figure 1:
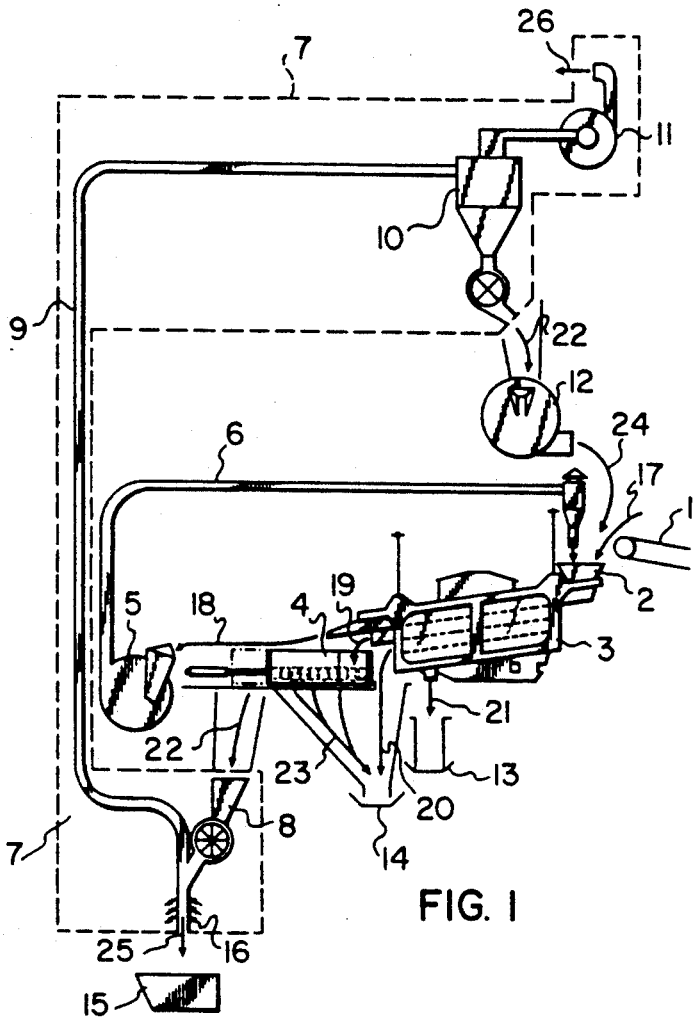
FIG. 1 is a simplified diagram representing an embodiment of the invention in lateral view.

Referring now to the drawings, the apparatus comprises a feed conveyor 1 and a gyratory screen 3 having a funnel-shaped infeed end 2 for receiving an incoming chip flow 17 and three parallel screen decks 27 to 29 sloping downwards in the direction of the chip flow, each deck having a different screen size. The screen size of the topmost deck 27 is chosen so that most of an oversized fraction 18 will remain on top of the deck 27. The screen size is preferably within the range of D45 . . . D55 mm. The screen size of the intermediate deck 28 is within the range D20 . . . D45 mm. For example, if a screen size of D24 mm is selected, then, in terms of normal chip size classification, about 90% of the overthick fraction can be screened prior to input to the thickness screening stage. The combined offtake of decks 27 and 28 equals about 32% of the total amount of chips. The bottommost screen deck 29 has a screen size of D5 . . . D8 mm.

The topmost screen deck 27 is longer than the other decks and has a form that allows the oversized chip fraction remaining on top of it to pass into a pin chipper 5, which is placed directly after or beside the gyratory screen. Since the apparatus is shown in a diagrammatic form in the drawings, the layout of the various components is not necessarily in keeping with that of an actual apparatus. A tubular conveyor 6 carries the size-reduced chips flowing out of the pin chipper 5 back to the gyratory screen 3 for re-sorting, the output end of the tubular conveyor 6 being located directly above the infeed end 2 of the gyratory screen.

Figure 2:
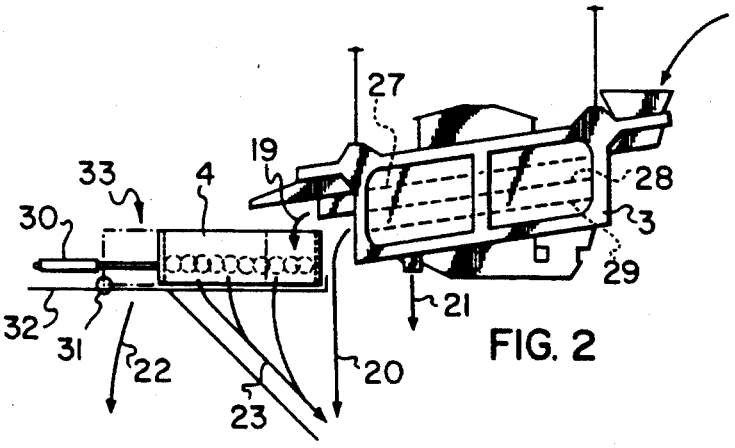
FIG. 2 shows diagrammatically on an enlarged scale the gyratory and disc screens of the apparatus of FIG. 1.
Figure 3:
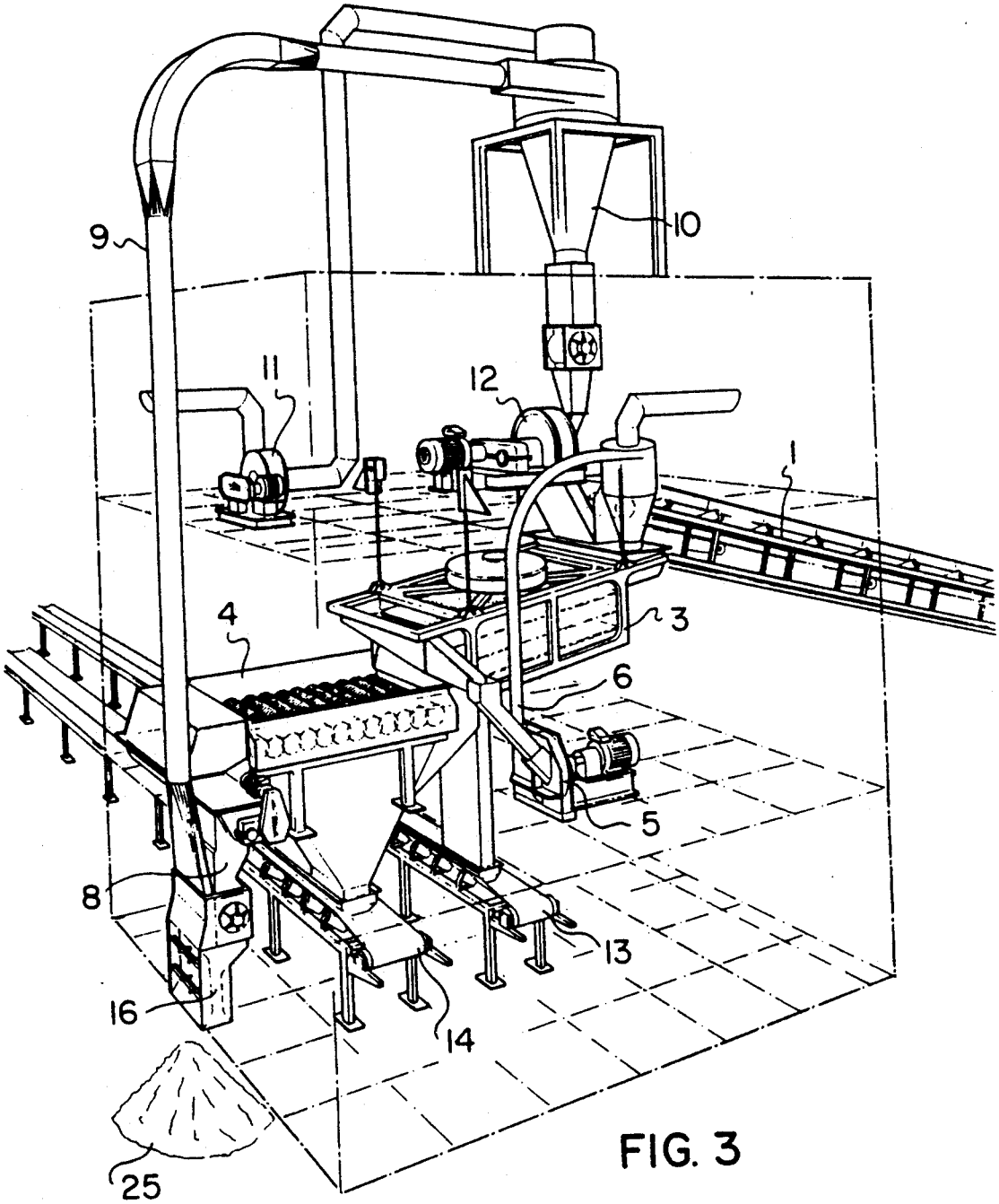
FIG. 3 is a perspective view of the apparatus shown in FIGS. 1 and 2.

Immediately after and below the gyratory screen is located a disc screen 4 used for thickness screening. The latter screen is of the same width as the gyratory screen and relatively short in the longitudinal direction. The apparatus comprises an arrangement by which the disc screen 4 can be moved horizontally in such manner that, during normal screening, a second chip fraction 19, which contains part of the acceptable fraction and most of the overthick fraction, falls from the lower end of the deck 28 as an even chip mat onto the screening elements of the disc screen. When the apparatus is operated with the disc screen in its outer position 33, (shown in phantom lines in FIG. 2), the chip flow 19 consisting of the second fraction falls past the disc screen and joins an accepted chip flow 20 (from the lower end of the deck 29) directly. The disc screen 4 is moved by a power means 30, such as a hydraulic cylinder capable of pushing and pulling the screen, with the piston coupled to the disc screen and the cylinder to a fixed part of the apparatus. The disc screen moves on wheels 31 along a track 32.

The intermediate deck 28 of the gyratory screen is shorter than the topmost deck 27 but longer than the bottommost deck 29, so that the chip flow proceeding from the intermediate deck 28 will not be mixed with the chips flowing from the other decks. The third chip fraction 20 obtained from the top of the bottommost screen deck 29 consists mainly of acceptable chips and falls directly onto a conveyor 14 and is fed into a digester (not shown).

The bottom of the gyratory screen is provided with an aperture for removal of the fourth fraction 21, which consists of material, mainly fine particles, that has passed through the bottommost screen deck 29. This smallest sized fraction falls onto a conveyor 13 which carries it to a burning station (not shown).

The overthick chip fraction 22 flowing from the top of the disc screen 4 falls into a feed funnel 8 of suction separator equipment 7, the funnel being placed below the disc screen.

Besides the feed funnel 8, the suction separator equipment 7 also comprises an exit opening 16 for material flow 25 consisting of rocks, metal objects, pieces of knot wood and other heavy objects. Below the exit opening 16 is a refuse container 15 for this heavy material. The feed funnel 8 also communicates with a suction tube 9 which runs upwards and sideways, leading to a cyclone 10 at its upper end. At the top of the cyclone 10 is a pump 11 which generates a negative pressure in the suction system. At the bottom of the cyclone is an exit opening through which the purified chip fraction 22 supplied by the suction separator 7 falls down into a chip slicing machine 12 placed below the cyclone exit opening. The slicing machine is placed above the infeed end 2 of the gyratory screen 3 in such manner that a chip flow 24 consisting of the fraction of sliced chips delivered from the exit opening of the slicing machine 12 falls directly into the feed opening 2 of the gyratory screen 3.

A brief description will now be given of an embodiment of the process of the invention for sorting wood chips. The chips 17 arriving for sorting are supplied to the infeed end 2 of the gyratory screen 3 by a known method, e.g. using the feed conveyor 1. In the first stage of the sorting process, the chips are sorted by the gyratory screen 3, whose topmost screen deck 27 outputs a first chip fraction 18 containing the roughest, mainly oversized chips. This oversized chip fraction 18 is fed into the pin chipper 5 for size reduction, from whence the tube conveyor 6 recycles the reduced chips back to the infeed end 2 of the gyratory screen.

The intermediate deck 28 of the gyratory screen 3 outputs a second fraction 19 containing accepted chips and most of the overthick chips. This chip flow is directed to the disc screen 4 for thickness screening, from whence the overthick fraction falls into the feed funnel 8 of the suction separator 7. Since a negative pressure prevails in the suction separator 7, the light chips are drawn into the suction tube 9, whereas heavier material 25, such as rocks, metal objects and pieces of knot wood, falls down through the exit opening 16 of the suction separator. The suction tube 9 brings the chips into the cyclone 10, where suction air 26 is separated from the chips. The suction air 26 is discharged through the exit opening of the pump 11.

The chips 22 freed of undesirable material are passed from the cyclone to the slicing machine 12, for size reduction. The size-reduced chip fraction 24 thus obtained is fed back into the gyratory screen infeed opening 2 for re-sorting. Bringing this chip fraction 24 obtained from the slicing machine back to the first screening stage provides an advantage, because the slicing machine always generates fine particles which, if allowed to enter the digester, would result in a deterioration of pulp quality. With the proposed arrangement, the fine particles thus generated can be removed along with the rest of the fine material 21 from the bottom of the gyratory screen. The fraction 23 which has passed through the disc screen consists of chips of acceptable size and is admitted into the pulping process. The third fraction, obtained from the lowest screen deck 29, contains mainly acceptable chips and falls directly onto a conveyor 14 which takes it either to the digester or to storage to await pulping. The fourth fraction 21 consists of fine material, mainly sawdust, that has passed through all three screen decks and is taken to a burning station by conveyor 13.

The slicing machine is a most sensitive device and requires frequent servicing e.g. when the cutters need to be changed. In such situations, it has generally been necessary to stop the entire sorting apparatus, because, during stand-still of the slicing machine there has been means of accommodating a continuing supply of overthick chips. The present invention solves this problem in that the disc screen is temporarily removed from its normal position for the time required for servicing the slicing machine. During this time, the second chip fraction 19, instead of being directed to the disc screen 4, is allowed to join the accepted fraction 20 directly and is conveyed therewith to the digester. This involves a slight temporary deterioration in the pulp quality. However, when compared with previously known techniques, which generally have no provision for thickness screening at all, it will be found that the pulp quality is never inferior to that generally obtained by current methods. The same procedure is also applicable when the disc screen needs servicing.

It will be obvious to a person skilled in the art that different embodiments of the invention are possible and that the invention is not restricted to the example described above, but may instead be varied within the scope of the following claims.

What is claimed is:

1. An apparatus for sorting and sizing wood chips for a pulping process, comprising:

a chip feeder (2), for receiving a flow of incoming chips;

a gyratory screen (3) with at least three screen decks (27, 28, 29) for receiving said flow of incoming chips and separating it into: a flow (18) of oversized chips; a flow (19) of acceptable and overthick chips; a flow (20) of acceptable chips; and, a flow (21) of fines;

a pin chipper (5) for reducing the size of said oversized chips;

a thickness screen (4) for receiving said flow of acceptable and overthick chips for further separating it into a flow (23) of acceptable chips and a flow (22) of overthick chips;

first conveying means (14) for conveying said flows of acceptable chips obtained from said gyratory screen and from said thickness screen into a pulping process or into storage to await pulping;

second conveying means (6) for recycling a flow of size-reduced chips from said pin chipper, back to said chip feeder; and means for reducing the size of said flow of overthick chips;

wherein:

a) said gyratory screen comprises means connected to each of said screen decks for separately directing: said flow of oversized chips to said pin chipper; said flow of acceptable and overthick chips to said thickness screen; said flow of acceptable chips to said first conveying means; and said flow of fines to a burning station, b) the thickness screen comprises a disc screen and is located below an output end of a second deck of the gyratory screen such that said flow (19) of acceptable and overthick chips falls from the gyratory screen directly onto the disc screen, said disc screen being movably mounted such that it can be displaced into and out of the path of said flow (19) of acceptable and overthick chips to enable maintenance and repair operations without requiring a total apparatus shutdown, and c) said means for reducing the size of said flow of overthick chips, comprising:

means (7) for separating rocks and metal particles therefrom; and third conveying means (9, 10, 11) for directing said flow of overthick chips, freed of rocks and metal particles, to a slicing machine; said slicing machine (12) receiving said flow (22) of overthick chips, reducing the thickness of said overthick chips and directing the thickness-reduced chips (24) to said chip feeder.

2. An apparatus as claimed in claim 1, wherein said second and third conveying means are pneumatic.

3. An apparatus according to claim 1, wherein the disc screen is supported by wheels (31) rotatably mounted on its lower part and running along a pair of essentially horizontal rails (32) provided below the screen, and power means (30) capable of pushing and pulling the screen is provided for moving the disc screen in and out of the path of said flow of acceptable and overthick chips, one end of said power means being attached to the disc screen and another, opposite end to a fixed part of the apparatus.

4. An apparatus for sorting and sizing wood chips for a pulping process, comprising:

a chip feeder (2), for receiving a flow of incoming chips;

a gyratory screen (3) with at least three screen decks (27, 28, 29) for receiving said flow of incoming chips and separating it into: a flow (18) of oversized chips; a flow (19) of acceptable and overthick chips; a flow (20) of acceptable chips; and a flow (21) of fines;

a pin chipper (5) for reducing the size of said oversized chips;

a thickness screen (4) for receiving said flow of acceptable and overthick chips for further separating it into a flow (23) of acceptable chips and a flow (22) of overthick chips;

first conveying means (14) for conveying said flows of acceptable chips obtained from said gyratory screen and from said thickness screen into a pulping process or into storage to await pulping;

second conveying means (6) for recycling a flow of size-reduced chips from said pin chipper, back to said chip feeder; and means for reducing the size of said flow of overthick chips;

wherein:

a) said gyratory screen comprises means connected to each of said screen decks for separately directing: said flow of oversized chips to said pin chipper; said flow of acceptable and overthick chips to said thickness screen; said flow of acceptable chips to said first conveying means; and said flow of fines to a burning station, b) the thickness screen comprises a disc screen and is located below an output end of a second deck of the gyratory screen such that said flow (19) of acceptable and overthick chips falls from the gyratory screen directly onto the disc screen, and c) said means for reducing the size of said flow of overthick chips, comprises:

third conveying means (9, 10, 11) for directing said flow of overthick chips to a slicing machine (12); said slicing machine (12) receiving said flow (22) of overthick chips, reducing the thickness of said overthick chips and directing the thickness-reduced chips (24) to said chip feeder.

5. An apparatus as claimed in claim 4, wherein said disc screen is movably mounted such that it can be displaced into and out of the path of said flow (19) of acceptable and overthick chips to enable maintenance and repair operations without requiring a total apparatus shutdown.

6. An apparatus as claimed in claim 5, wherein the disc screen is supported by wheels (31) rotatably mounted on its lower part and running along a pair of essentially horizontal rails (32) provided below the screen, and power means (30) capable of pushing and pulling the screen is provided for moving the disc screen in and out of the path of said flow of acceptable and overthick chips, one end of said power means being attached to the disc screen and another, opposite end to a fixed part of the apparatus.

7. An apparatus as claimed in claim 4, wherein said means for reducing the size of said flow of overthick chips further includes means (7) for separating rocks and metal particles therefrom prior to direction of said flow of overthick chips to said slicing machine.

8. An apparatus according to claim 4, wherein the disc screen is supported by wheels (31) rotatably mounted on its lower part and running along a pair of essentially horizontal rails (32) provided below the screen, and power means (30) capable of pushing and pulling the screen is provided for moving the disc screen in and out of the path of said flow of acceptable and overthick chips, one end of said power means being attached to the disc screen and another, opposite end to a fixed part of the apparatus.

9. An apparatus as claimed in claim 4, wherein said second and third conveying means are pneumatic.

* * * * *